United States Patent [19]

Bredderman et al.

[11] Patent Number: 4,537,451

[45] Date of Patent: Aug. 27, 1985

[54] HANGING LOCKER SHELVES

[76] Inventors: Theodore Bredderman; Virginia Bredderman; Kathryn Bredderman; David Bredderman, all of #3 Sunset Dr., Delmar, N.Y. 12054

[21] Appl. No.: 469,998

[22] Filed: Apr. 13, 1983

[51] Int. Cl.[3] ..... A47B 61/00

[52] U.S. Cl. ..... 312/6; 312/3

[58] Field of Search ..... 211/195; 108/149; 312/3, 4, 6, 245, 321; 248/302, 214, 205.1

[56] References Cited

U.S. PATENT DOCUMENTS

| | | | |
|---|---|---|---|
| 1,227,723 | 2/1915 | Wilson | 108/111 |
| 1,640,083 | 8/1977 | Ladd | 312/6 |
| 1,847,066 | 1/1932 | Berg . | |
| 1,981,510 | 11/1934 | Jones | 312/3 |
| 2,440,192 | 4/1948 | Cowan | 312/6 |
| 2,533,725 | 12/1950 | Eisenberg | 211/63 |
| 2,671,706 | 3/1954 | Greengold | 312/4 |
| 2,747,825 | 5/1956 | Lachenmayer | 248/302 |
| 3,212,742 | 10/1965 | Pavoni | 248/302 |
| 3,429,541 | 2/1969 | Herman | 248/302 |
| 3,519,318 | 7/1970 | Hagen | 312/245 |
| 3,904,258 | 9/1975 | Faulkenberry | 312/6 |
| 4,122,782 | 10/1978 | Coombs | 108/99 |
| 4,158,905 | 6/1979 | O'Leary | 24/530 |
| 4,418,883 | 12/1983 | Cohen | 248/205.1 |

OTHER PUBLICATIONS

IBM Technical Disclosure Bulletin vol. 14 No. 3, Aug. 1971 p. 889.

*Primary Examiner*—William E. Lyddane
*Assistant Examiner*—Joseph Falk
*Attorney, Agent, or Firm*—Allen C. Miller, Jr.

[57] ABSTRACT

A device for the storage of articles in conventional lockers of the type found in schools, gymnasia and other, similar institutions, including a collapsible support assembly made of fabric or plastic, from which depends a multiplicity of rigid, vertically spaced shelves, the entirety of which is suspended from a shelf in the locker by means of a bent, rigid rod which in part rests upon the upper surface of said shelf.

1 Claim, 6 Drawing Figures

Fig. 2
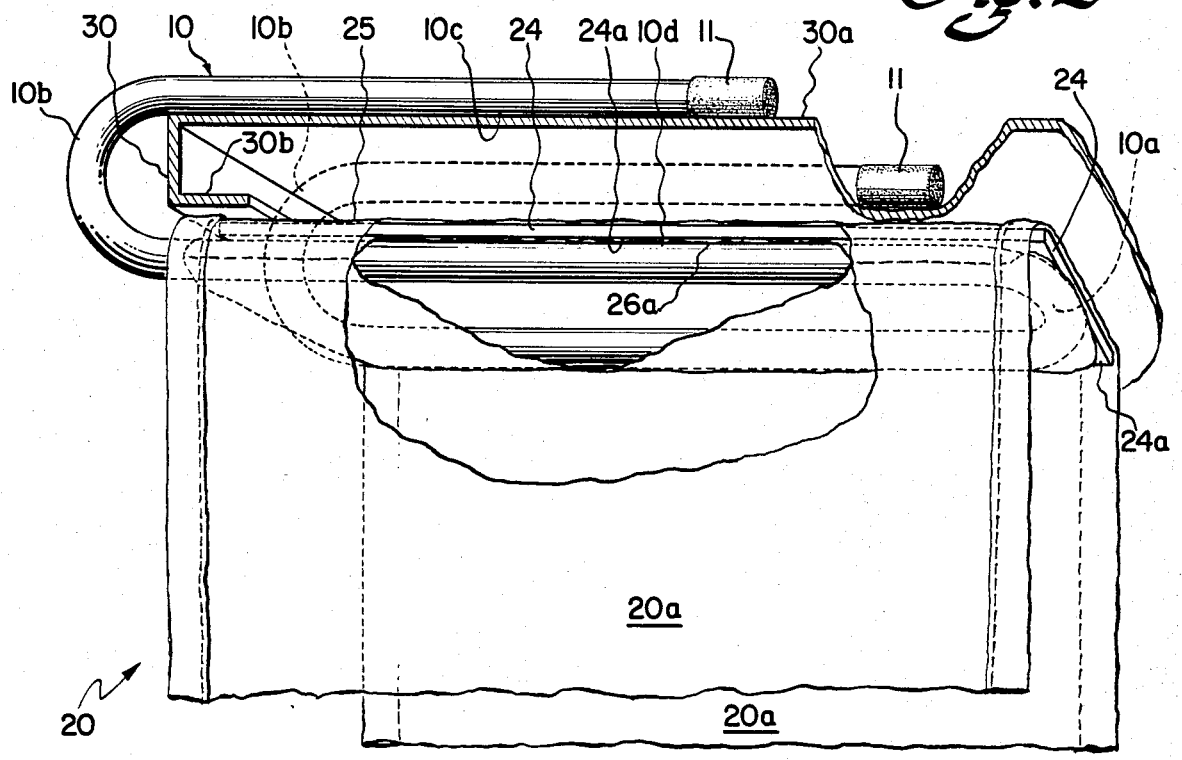
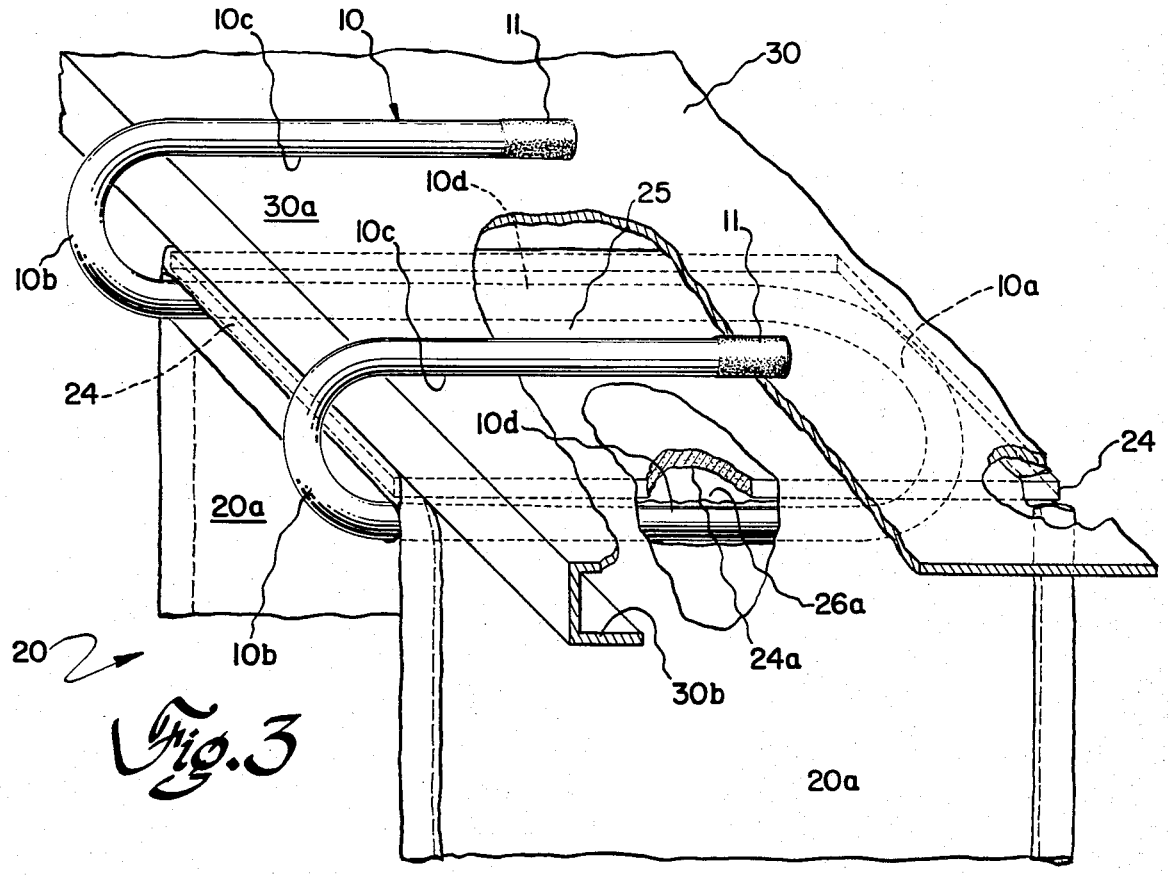
Fig. 3

Fig. 4
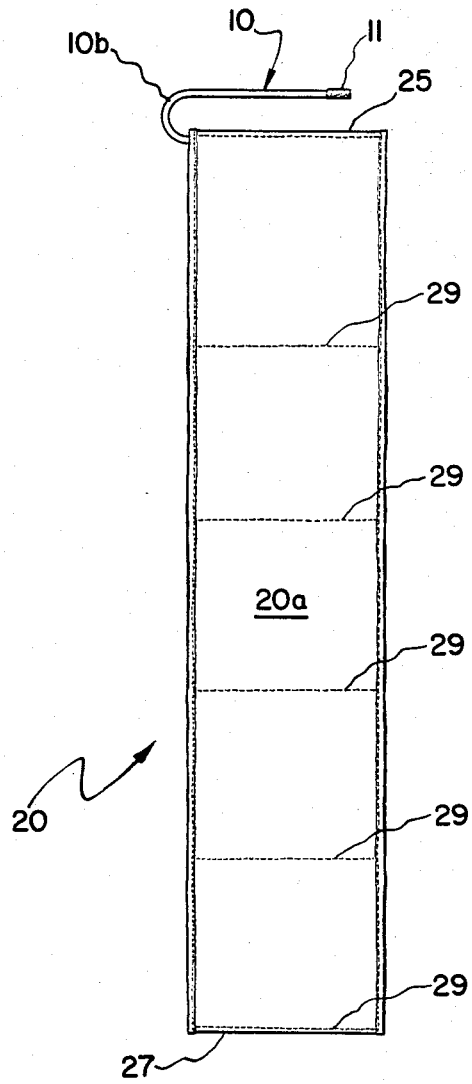
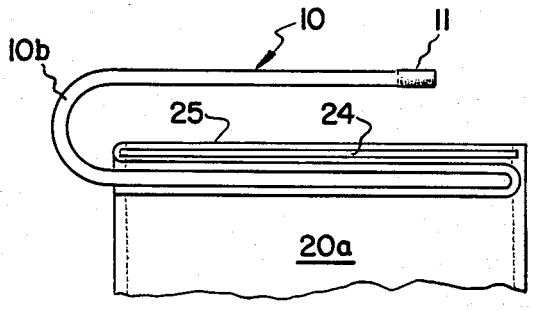
Fig. 6
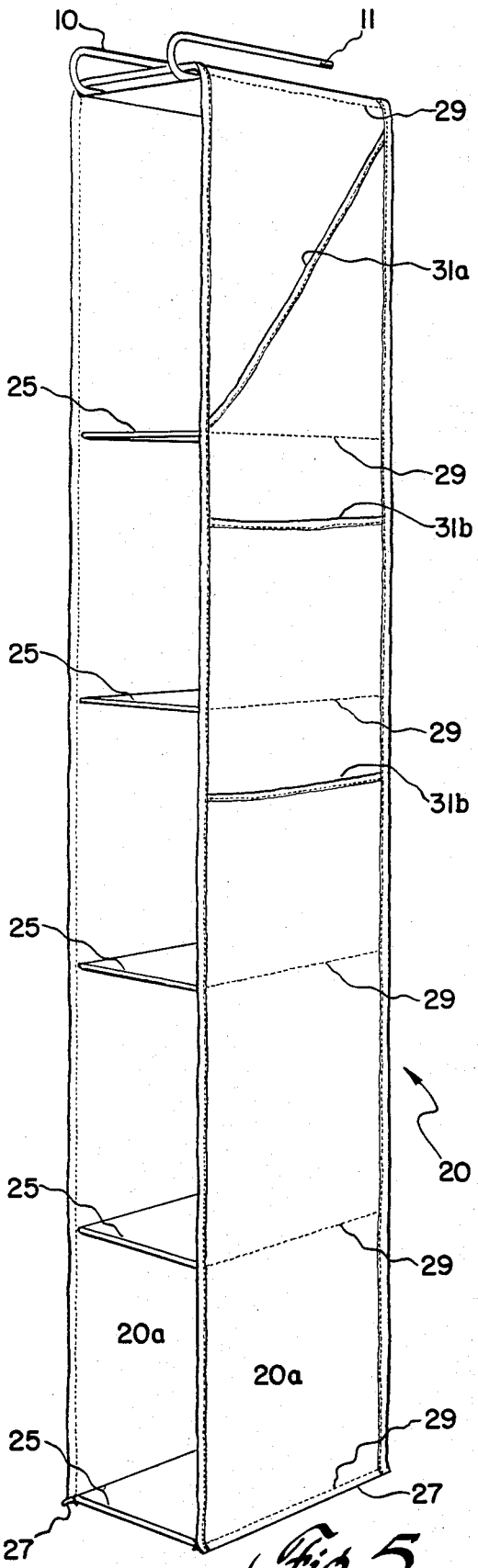
Fig. 5

HANGING LOCKER SHELVES

BACKGROUND OF THE INVENTION

Nearly every single high school child in this country contends with the nearly insurmountable challenge of storing books, notes and papers, meals, clothing and other learning periphernalia within the constricted confines of the standard school locker. This space, in its typical configuration, is several times taller than it is wide or deep. Storage is usually confined to lowermost levels of the locker, with but only the lightest or most used articles enjoying plain view, the rest being consigned to burial beneath several strata of last semester's biology notes.

The primary fault inherent in the typical vertically oriented locker is the lack of storage shelves except at the very top. This results in the placement of stored articles, one on the top of the other, resulting in disorganization and inefficient storage.

Another problem with school and other "public" lockers is the frequency with which their users change. This factor precludes the user from installing permanent shelves. Any occupant of such a locker who wishes to have vertically spaced shelving accordingly to utilize a readily detachable means of installing the shelves, and one which will not scratch, deform or otherwise alter locker's interior.

The inventors have answered the problem of providing shelves in vertical lockers without damaging the locker itself. The shelves are readily detachable, yet, when in place are sufficiently fixed and rigid so as to meet the user's anticipated needs.

SUMMARY OF INVENTION

This invention is an array of storage shelving specially configured for temporary installation in vertically oriented lockers commonly encountered in such buildings as schools and gymnasia. The device of the invention includes a plurality of collapsible shelves oriented vertically with respect to one another and suspended by means of two lateral flexible supports. The shelves are situated at fixed intervals in the manner more particularly described herein. The number of shelves and their respective inter-spacings may be varied to accomodate the particular storage needs of the user. Similarly, the width and depth of each shelf is variant with a particular locker's dimensions. The principal features of the invention are not dependent upon the precise embodiment as herein disclosed.

While the sidewalls of our hanging shelves are collapsible, the horizontal shelf surfaces are made rigid and are capable of supporting the weight loads normally encountered in the use of a locker.

The entire hanging shelves assembly is designed to depend from a metal shelf located in the upper portion of the locker, and herein lies the novelty of our invention. A bent metal support device provides adequate support of the hanging shelf assembly, yet permits easy installation and removal of shelves without damage to the locker.

The reinforced shelves of this invention are fixed to the flexible sidewalls by continuous seams. All panel surfaces are bound for additional weight-bearing strength and durability.

DETAILED DESCRIPTION OF THE INVENTION

This invention may be better described by reference to the accompanying drawings:

FIG. 2 is a perspective view of the bent metal supporting rod as it normally depends from a sheetmetal locker shelf.

FIG. 3 is a fragmentary perspective view of the bent rod supporting device received into the upper portion of the fabric supporting assembly containing the fixed shelves.

FIG. 4 is a side elevational view of one of the flexible sidewalls of the shelf supporting assembly.

FIG. 5 is a perspective view of the collapsible fabric shelving assembly showing more particularly the details of construction thereof.

FIG. 6 is a schematic showing the support rod in relation to the flexible support panel and uppermost reinforcing batten.

Figure 1:
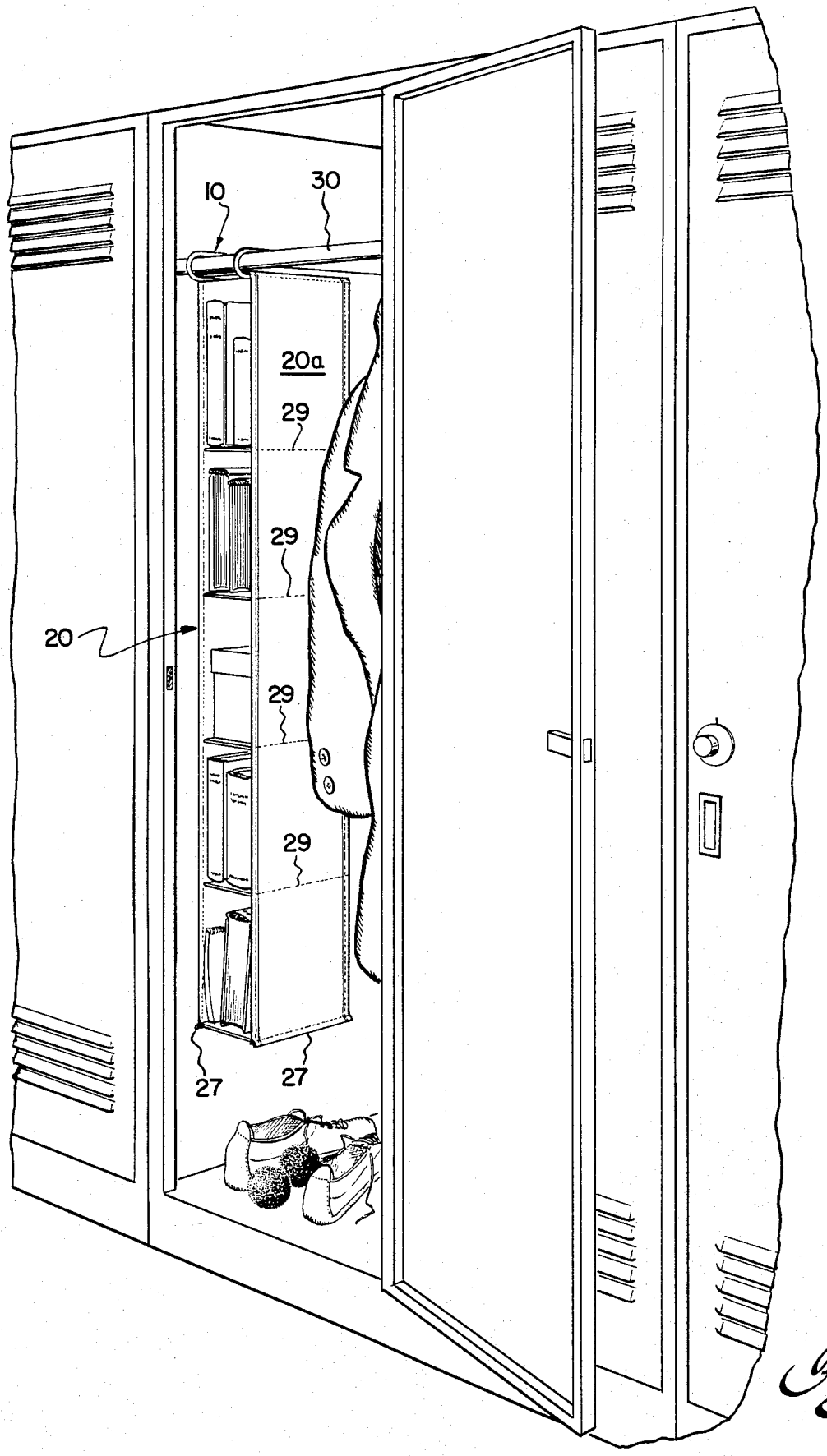
FIG. 1 is a perspective view of the hanging locker shelves as ordinarily used.

The device illustrated in the drawings includes a bent metal rod supporting device 10. This rod is bent about a horizontal radius at its center and its ends are further upwardly bent around vertical radii as appears in FIG. 2. The central bend 10*a* is about such a radius as to conform with the desired shelf width, which varies with the particular application, but remains the same in principle. The vertical curves 10*b* of each upper arm are about such radii as to per mit a loose sliding fit between lowermost surfaces of the rod's upper arms 10*c* and the top surface 30*a* of the locker shelf 30, while at the same time allowing slidable clearance between the top surface 10*d* of the supporting rod 10 and the bottom lip of the locker shelf 30*b*. The ends of the upper arms 10*c* are coated with a cushioning, plastic material 11.

The supporting device 10 is received into the pocket existing between the uppermost flexible horizontal panel and the bottom horizontal surface 24*a* of the uppermost reinforcement batten 24, as illustrated in FIG. 3. In this configuration, the weight of articles supported by the dependent shelves 25 is translated from the uppermost batten's lower surface 24*a* to the support rod 10 along its lengths shown as 10*d*, and subsequently is directed along the extrema of rod 10 so as to downwardly direct the entire array's weight onto the upper surface 30*a* of the locker shelf 30.

Details of the hanging shelves' construction are shown in FIG. 5. Each shelf 25 consists of two fabric or other flexible panels. A batten 24 made of any lightweight, rigid material (such as, but not limited to wood or hardboard) is inserted between the flexible panels, in such way as to form a flat, inflexible shelf. The width of the batten 24 is slightly inferior to that of the two fabric liners so as to permit the batten to be received between them.

Each individual shelf assembly 25 is joined to sidewalls 20*a* along the seams 29. In the case of the lowermost batten the horizontal panel section 25 is joined into a folded seam 27, as depicted in FIGS. 3 and 5.

Friction between the plastic coatings 11 and the shelf prevents movement of the hanging shelves within the locker.

Similarly, the battens may be fashioned of any lightweight material of sufficient rigidity and strength to support the modest weight loads of books and school supplies. The support rod may be fashioned of any metal or other material having sufficient rigidity and shearing strength to translate the dependent structure's weight along its length to the locker shelf. While we have illustrated a particular embodiment of the device using specific details of construction and specific materials, it will be obvious to those skilled in the art that other construction details may be employed and other materials used. In particular, we disclose the suitability of plastic fabric or sheet material joined by thermoplastic means as a suitable alternative to the use of stitched fabric.

The number, breadth and depth, and spacing of the dependent shelves may vary according to need and application without altering the principals set forth herein. Additional pockets may be attached to the outer sidewalls of the device without altering the art disclosed herein.

The width of the shelves 25 is a particular application is determined according to the desired amount of shelf storage as opposed to the desired amount of vertical storage for such articles as coats and other articles of clothing. Likewise, the number and vertical spacing of the shelves varies with the user's requirements and the locker's dimensions.

What is claimed is:

1. A supporting device for suspending a shelf assembly from a horizontal locker shelf, said device comprising:

a rigid support member having upper parallel horizontally spaced arms for making direct weighted contact along their entire respective bottom surfaces with the upper horizontal surface of said locker shelf, said parallel arms respectively curving vertically downward into two lower parallel and horizontally spaced arms joined by a horizontally curved central portion, which central portion is designed to fit tautly into the uppermost pocket of a collapsible assembly of vertically spaced hanging shelves to suspend the assembly beneath the locker shelf;

said shelf assembly having a top wall and a plurality of side walls extending downwardly therefrom, and an additional wall extending between the side walls parallel to the top wall forming a pocket with the top wall to tautly receive the support member.

* * * * *